US009586754B1

(12) United States Patent
Faacks et al.

(10) Patent No.: US 9,586,754 B1
(45) Date of Patent: Mar. 7, 2017

(54) DUMPSTER BAG WITH STAND

(71) Applicants: Steve T. Faacks, Eau Claire, WI (US); Christopher C. Hansen, New Richmond, WI (US)

(72) Inventors: Steve T. Faacks, Eau Claire, WI (US); Christopher C. Hansen, New Richmond, WI (US)

(73) Assignee: Gorilla Dumpster Bag, LLC, Eau Claire, WI (US)

( * ) Notice: Subject to any disclaimer, the term of this patent is extended or adjusted under 35 U.S.C. 154(b) by 0 days.

(21) Appl. No.: 15/056,175

(22) Filed: Feb. 29, 2016

(51) Int. Cl.
*B65F 1/14* (2006.01)
*B65F 1/00* (2006.01)

(52) U.S. Cl.
CPC ..... *B65F 1/1415* (2013.01); *B65F 1/0006* (2013.01); *B65F 1/1452* (2013.01); *B65F 2250/1146* (2013.01)

(58) Field of Classification Search
CPC .... B65F 1/1415; B65F 1/1452; B65F 1/0006; B65F 2250/1146
USPC ..... 220/9.1–9.4, 495.01–495.09, 495.1, 220/495.11, 485–495
See application file for complete search history.

(56) References Cited

U.S. PATENT DOCUMENTS 3,593,768 A * 7/1971 Taub ..... G09F 5/00 206/466
4,723,741 A * 2/1988 Doering ..... B65B 67/1255 248/164
4,953,815 A * 9/1990 Beymer et al. ..... B65B 67/12 248/97
4,976,406 A * 12/1990 Buckley et al. ..... B62B 1/14 248/98
5,570,862 A * 11/1996 Nugent ..... B65B 67/1205 248/101
7,032,868 B2 * 4/2006 Mutert ..... B65B 67/1205 141/391
7,731,134 B1 * 6/2010 Mutert ..... B65B 67/1205 248/97
2002/0104932 A1 * 8/2002 Johnston ..... B65B 67/1205 248/97
2010/0012794 A1 * 1/2010 Dembowiak et al. B65F 1/1415 248/99
2010/0108826 A1 * 5/2010 Fernandez et al. ..... B65F 1/10 248/98
2011/0056519 A1 * 3/2011 Card et al. ..... B08B 17/00 134/10

* cited by examiner

*Primary Examiner* — Robert J Hicks
*Assistant Examiner* — Kareen Thomas
(74) *Attorney, Agent, or Firm* — Ruder Ware, L.L.S.C.

(57) ABSTRACT

A lightweight, easy to use, and cost effective dumpster bag with stand that addresses the shortcomings of both prior art traditional metal dumpsters and existing dumpster bags is provided. The preferred embodiment of the dumpster bag with stand includes a dumpster bag removably secured to a portable stand comprising a pair of support frames connected by a pair of cross-members. The dumpster bag includes lifting straps with lifting loops, and the dumpster bag is removably secured to the portable stand by removably securing at least four of the lifting loops to the support frames. Each support frame includes two vertical supports and at least two horizontal members, and each cross-member comprises two diagonal members attached via a pivot.

20 Claims, 8 Drawing Sheets

DUMPSTER BAG WITH STAND

BACKGROUND OF THE INVENTION

The invention disclosed herein relates to a dumpster bag with a stand and, more specifically, a dumpster bag that includes a portable rigid stand that supports the vertical walls of the dumpster bag. The present invention provides a dumpster bag with stand which may be used to allow the dumpster bag to be used more easily and efficiently.

Currently, large metal dumpsters are typically used for the disposal of larger items of waste. For example, such dumpsters are widely used in connection with construction activities to dispose of construction waste created at construction sites, at homes and buildings during remodeling, and similar sites. Likewise, smaller versions may be used in commercial contexts or to dispose of organic waste, yard waste, and the like. While these large metal dumpsters have a large capacity and are easy to use due to their rigid walls, they are also extremely heavy and often require special trucks to transport. As a result, once a dumpster has been placed in a particular location at a site, it is generally very difficult or impossible for the user to adjust the location of the dumpster in any practical or realistic way. Additionally, since special trucks are required to both deliver and pick up the dumpster from the work site, and since each truck often can only transport one dumpster at a time, the cost of renting or otherwise obtaining the dumpster is often quite high due to the higher labor and capital costs. Finally, although the large metal dumpsters can generally be used multiple times, the heavy metal construction means that the dumpster is more complicated to manufacture and is very expensive to purchase or replace.

As an alternative, more recently fabric dumpster bags have begun to replace the large metal dumpsters for some uses. With most such dumpster bags, the fabric bags are laid out at a location chosen by the user, filled, and then picked up by a truck with a hoist. Due to the bag being constructed of fabric, the dumpster bag is extremely light and can even be sold individually at home improvement stores without the need for a truck to deliver them. However, most dumpster bags are designed for a single use and, more importantly, have certain limitations. Due to the fabric construction of the bag, the sides of the dumpster bag typically do not have sufficient support to stand up or remain substantially vertical. This means that the user often needs to lift up the sides of the bag into a vertical position before placing items in the dumpster bag itself, which makes it more difficult to use effectively when the user is placing large, unwieldy items in the bag. This also places certain limits on the overall size of the dumpster bag, more specifically the depth of the dumpster bag, since if the depth of the dumpster bag is too big, the user will have a much more difficult time lifting the sides of the bag to put items in the dumpster bag. Also, due to their fabric construction, dumpster bags are typically quite light and, therefore, at least a few items must be placed into the bag as soon as it is set up in order to avoid the dumpster bag from blowing away due to wind.

As such, there is an existing need for a dumpster bag that combines the advantages of existing dumpster bags with the advantages of the traditional metal dumpsters.

BRIEF SUMMARY OF THE INVENTION

It is a feature of the present invention to provide a dumpster bag with a stand that results in a combination of a light-weight and cost-effective dumpster bag with a light-weight portable stand that allows a larger dumpster bag to be used while giving rigidity and strength to the walls of the dumpster bag itself.

The present invention aims to address at least some of the problems with both prior art traditional metal dumpsters and existing dumpster bags. More specifically, the dumpster bag with stand of the present invention can easily be moved around by the user before items begin to be placed in the bag due to the light weight of the dumpster bag and the light-weight construction of the stand, yet the weight of the stand also means that the user does not need to worry about the dumpster bag from blowing away during normal winds. The dumpster bag with stand of the present invention also allows a larger size of dumpster bag with higher walls to be utilized, allowing the dumpster bag to hold a much greater amount of waste, while the stand gives rigidity to the walls of the dumpster bag, making the dumpster bag much easier for the user to load. Once the dumpster bag is loaded, the dumpster bag can be removed from the stand using a truck with a hoist, and the stand is disassembled and stored elsewhere on the truck. Since the stand can be disassembled, and since the dumpster bag becomes flexible once it has been placed in the truck, the truck can be used to pick up multiple dumpster bags on the same trip, thereby being much more cost effective than traditional metal dumpsters. Likewise, multiple dumpster bags and stands can be dropped off at the locations for multiple users, and optionally set up by the individual making the deliveries, on the same trip, which again makes the use of the dumpster bag with stand of the present invention more cost effective than traditional metal dumpsters.

The dumpster bag with stand of the present invention comprises a dumpster bag with four walls and a bottom together with multiple lifting loops that are removably attached to a stand comprising two primary supports connected by two cross-members. Additionally, the dumpster bag is constructed of polypropylene such that, although the dumpster bag of the present invention remains a one-use item, used dumpster bags can be easily and cost-effectively recycled and used to produce new dumpster bags, eliminating the waste created by the used bag.

DETAILED DESCRIPTION OF THE PREFERRED EMBODIMENT(S)

Embodiments of the present invention provide a dumpster bag with stand that is lightweight, easy to use, cost effective, and addresses the shortcomings of both prior art traditional metal dumpsters and existing dumpster bags.

Figure 1:
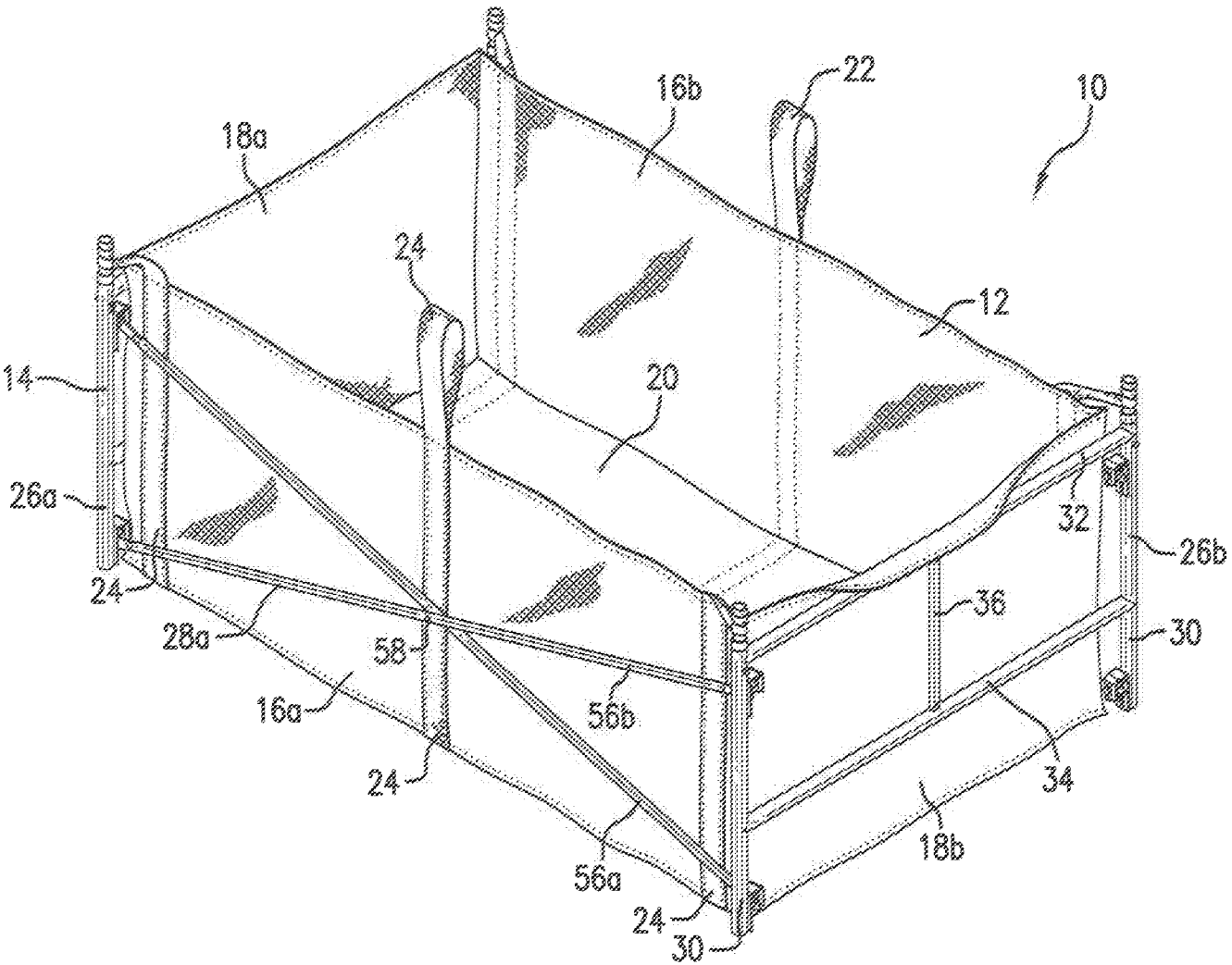
FIG. 1 is a perspective view of the dumpster bag with stand of the present invention, with the dumpster bag secured within the portable stand.
Figure 2:
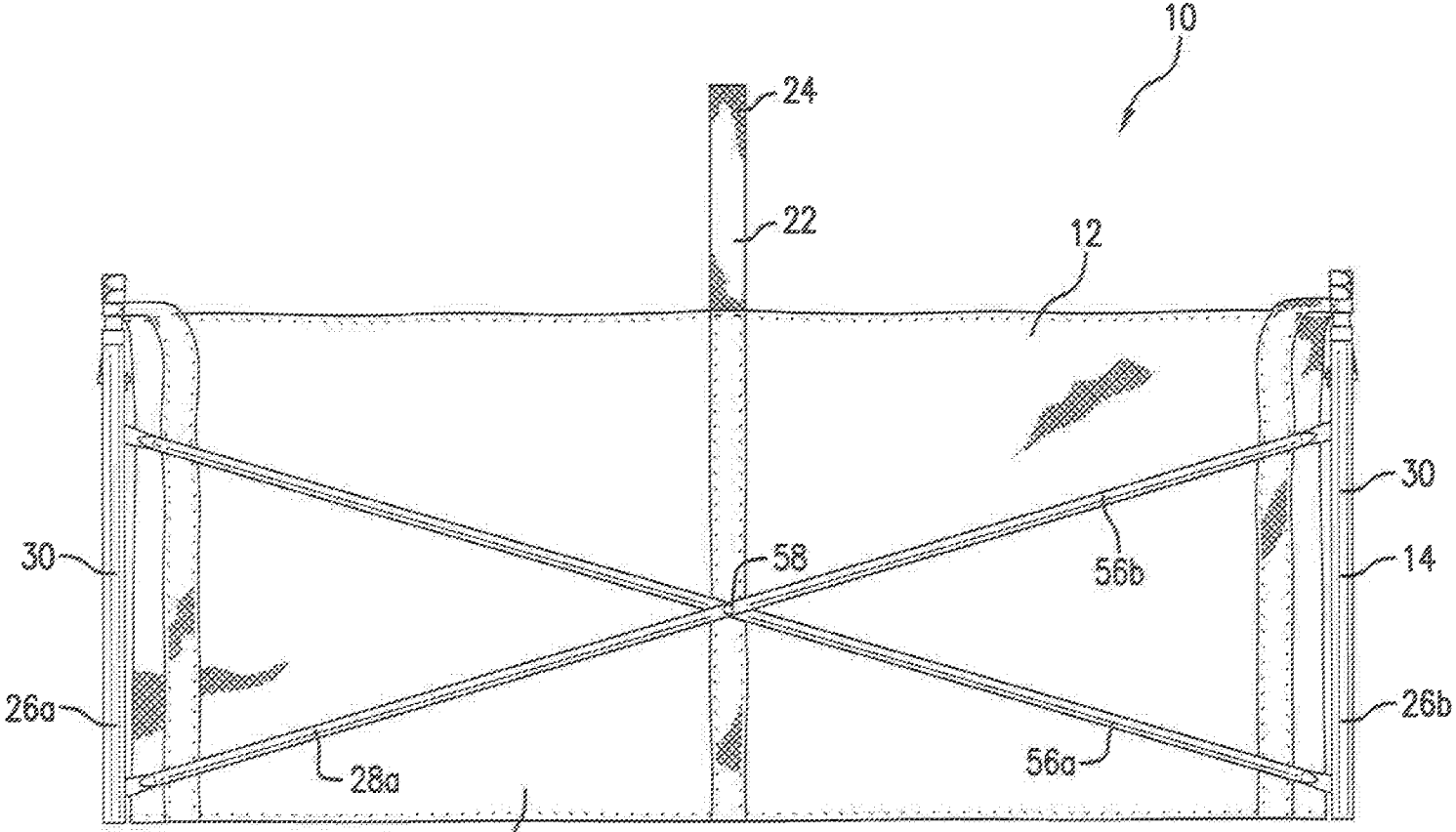
FIG. 2 is a front elevation view of the dumpster bag with stand of FIG. 1, with the dumpster bag secured within the portable stand.
Figure 3:
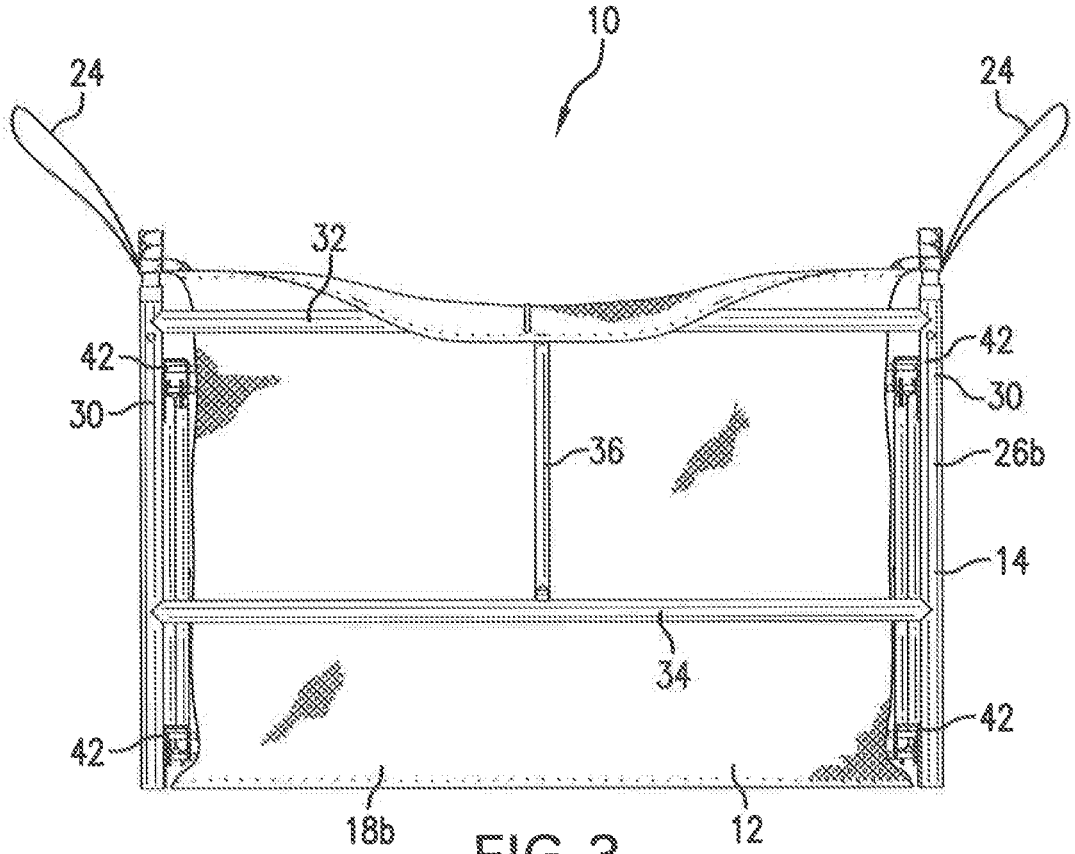
FIG. 3 is a side elevation view of the dumpster bag with stand of FIG. 1, with the dumpster bag secured within the portable stand.
Figure 4:
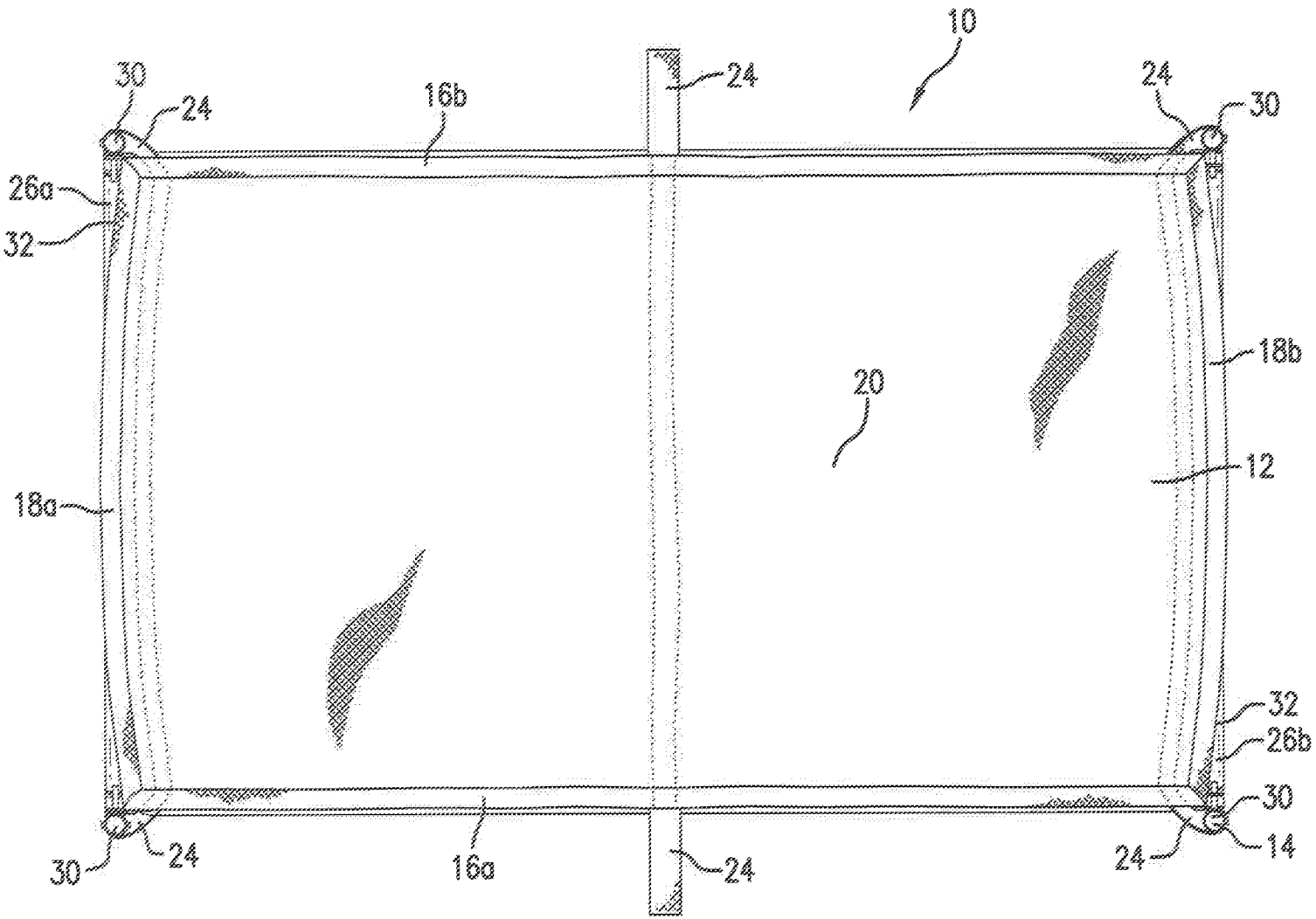
FIG. 4 is a top plan view of the dumpster bag with stand of FIG. 1, with the dumpster bag secured within the portable stand.
Figure 5:
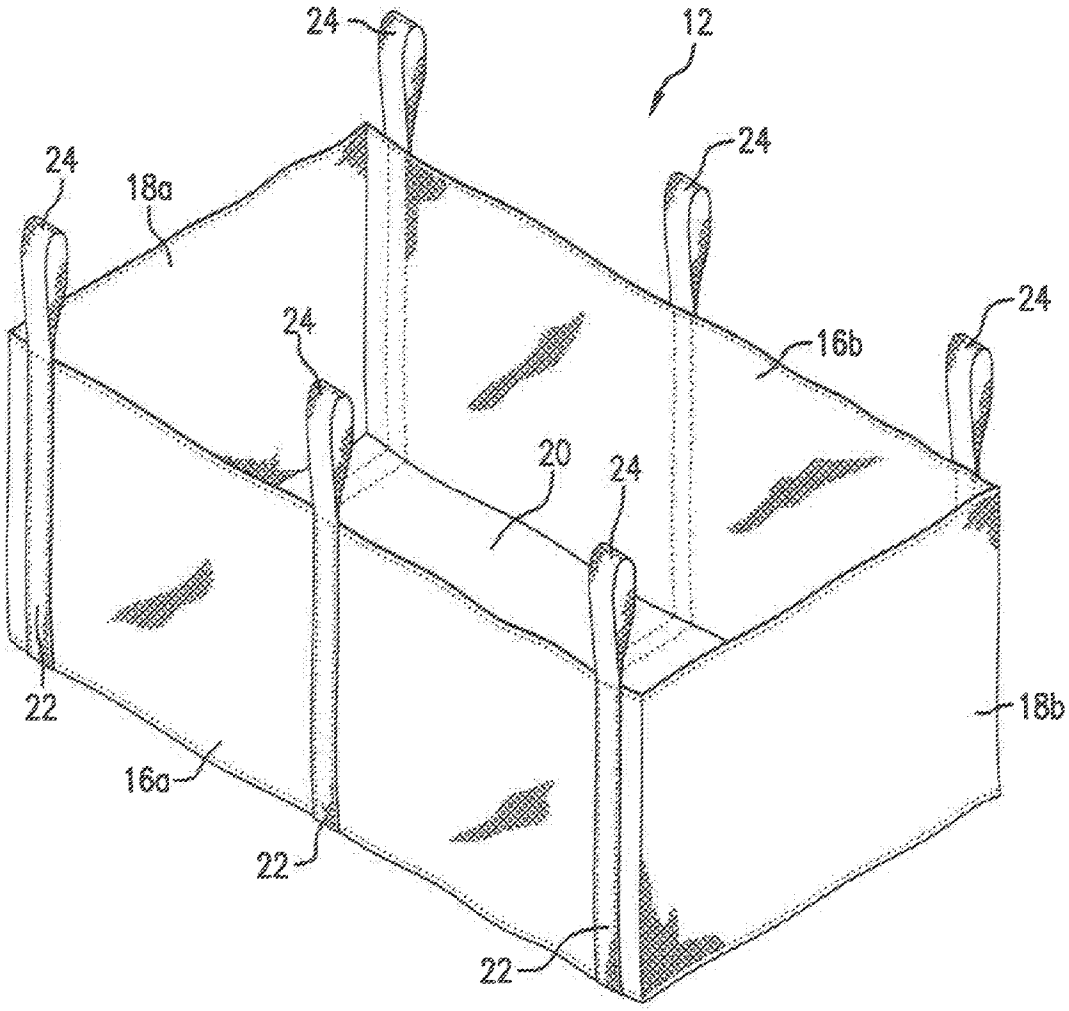
FIG. 5 is a perspective view of the dumpster bag of the present invention, shown separate from the portable stand.

Referring now to FIGS. 1 through 4, a preferred embodiment of the dumpster bag with stand 10 is shown. As best seen in FIG. 5, the dumpster bag with stand 10 comprises a flexible dumpster bag 12 together with a portable stand 14.

The dumpster bag 12 comprises a generally rectangular or square, open top, fabric bag and may be varied in size according to the desired use and size of the dumpster bag with stand 10 of the present invention. The dumpster bag includes a first side panel 16*a*, a second side panel 16*b*, a first end panel 18*a*, a second end panel 18*b*, and a bottom panel 20.

The first and second side panels 16*a*, 16*b* are attached to the first and second end panels 18*a*, 18*b* and the bottom panel 20 by continuous reinforced stitching. The first and second side panels 16*a*, 16*b* are also approximately equal in size. For example, in one embodiment of the dumpster bag 12, the dimensions of the first and second side panels 16*a*, 16*b* may be approximately 96 inches (244 cm) by 41.75 inches (106 cm).

Likewise, the first and second end panels 18*a*, 18*b* are attached to the first and second side panels 16*a*, 16*b* and the bottom panel 20 by continuous reinforced stitching. The first and second end panels XX18*a*, 18*b*XX are also approximately equal in size. For example, in one embodiment of the dumpster bag 12, the dimensions of the first and second end panels 18*a*, 18*b* may be approximately 60.25 inches (153 cm) by 41.75 inches (106 cm).

Finally, the bottom panel 20 is attached to the first and second side panels 16*a*, 16*b* and the first and second end panels 18*a*, 18*b* by continuous reinforced stitching. The bottom panel 20 has a length that is equal to the length of the first and second side panels 16*a*, 16*b* and a width that is equal to the length of the first and second end panels 18*a*, 18*b*. For example, in one embodiment of the dumpster bag 12, the dimensions of the bottom panel 20 may be approximately 96 inches (244 cm) by 60.25 inches (153 cm).

The connection of the first and second side panels 16*a*, 16*b*, first and second end panels 18*a*, 18*b* and bottom panel 20 as described herein results in a rectangular or square dumpster bag 12 with an open top.

The dumpster bag 12 also includes at least three lifting straps 22 made of a woven fabric material stitched vertically to the first and second side panels 16*a*, 16*b* and across the bottom panel 20. That is, the lifting straps 22 of the dumpster bag 12 are continuous straps that extend down the sides of and across the bottom of the dumpster bag 12. As such, the specific length of the lifting straps 12 will depend upon the height of the first and second side panels 16*a*, 16*b* and the width of the bottom panel 20 of the dumpster bag 12. For example, in one embodiment of the dumpster bag 12, the total length of the lifting straps 22 (including the material used to create the lifting loops described below) is approximately 246 inches (625 cm).

Each end of the lifting straps 22 includes a lifting loop 24, for a total of at least three lifting loops 24 on each side of the dumpster bag 12. In order to construct the lifting loops 24, the lift straps 22 are cut to be much longer than needed to cover the perimeter of the dumpster bag 12. Each end of the lifting strap 22 is then looped back on itself and attached to both the dumpster bag 12 and an interior portion of the lift strap 22 with continuous reinforced stitching to create the lifting loop 24. Preferably, there is overlap between the end of the lifting strap 22 and the interior portions of the lifting strap 22 in order to create a strong, durable lifting loop 24. For example, in one embodiment of the dumpster bag 12, where the total length of the lifting strap 22 is approximately 246 inches (625 cm) in length, the approximate overlap between the end of the lifting strap 22 and the interior portions of the lifting strap 22 is approximately 31.5 inches (80 cm), which results in an overall length of the lifting strap 24, once it has been attached to the first and second side panels 16*a*, 16*b* and bottom panel 20 of the dumpster bag 12 and the lifting loops 22 created, of approximately 183 inches (465 cm). In such an embodiment, the lifting loops 24 extend approximately 19.75 inches (50 cm) above the top edge of the first and second side panels 16*a*, 16*b*.

The use of the lifting straps 24, and the creation of a nearly complete loop around the dumpster bag 12, once the lifting straps have been secured to a lift hoist to lift the dumpster bag into a transportation vehicle, allows the weight of the waste held by the bag to transfer to and be distributed by the lift straps 22 throughout the dumpster bag 12.

The dumpster bag 12, including the lifting straps 22, is constructed of a flexible but durable woven polypropylene fabric. The use of polypropylene fabric allows the dumpster bag to remain lightweight, easy to move at the work site prior to filling, easy to transport, easy to set up, and ready to use once it is attached to the stand 14. The polypropylene material from which the dumpster bag 12 is constructed may be coated or uncoated depending on the working load and desired use of the dumpster bag 12. The use of polypropylene materials for the fabric of the dumpster bag 12 also allows the dumpster bag 12 to be flexible and collapsible, which allows it to be folded up for easy storage prior to use, easy transportation to the work site, and easy disposal once the dumpster bag 12 has been filled, picked up, and emptied at a disposal site.

For example, in a preferred embodiment, the dumpster bag 12 may be constructed of 100% virgin polypropylene with a density of 190 grams per square meter. If such materials are used in connection with an embodiment of the dumpster bag 12 having the approximate dimensions discussed herein, the dumpster bag 12 will have a safe working load (SWL) of approximately 3,968 pounds (1,800 kg).

Figure 6:
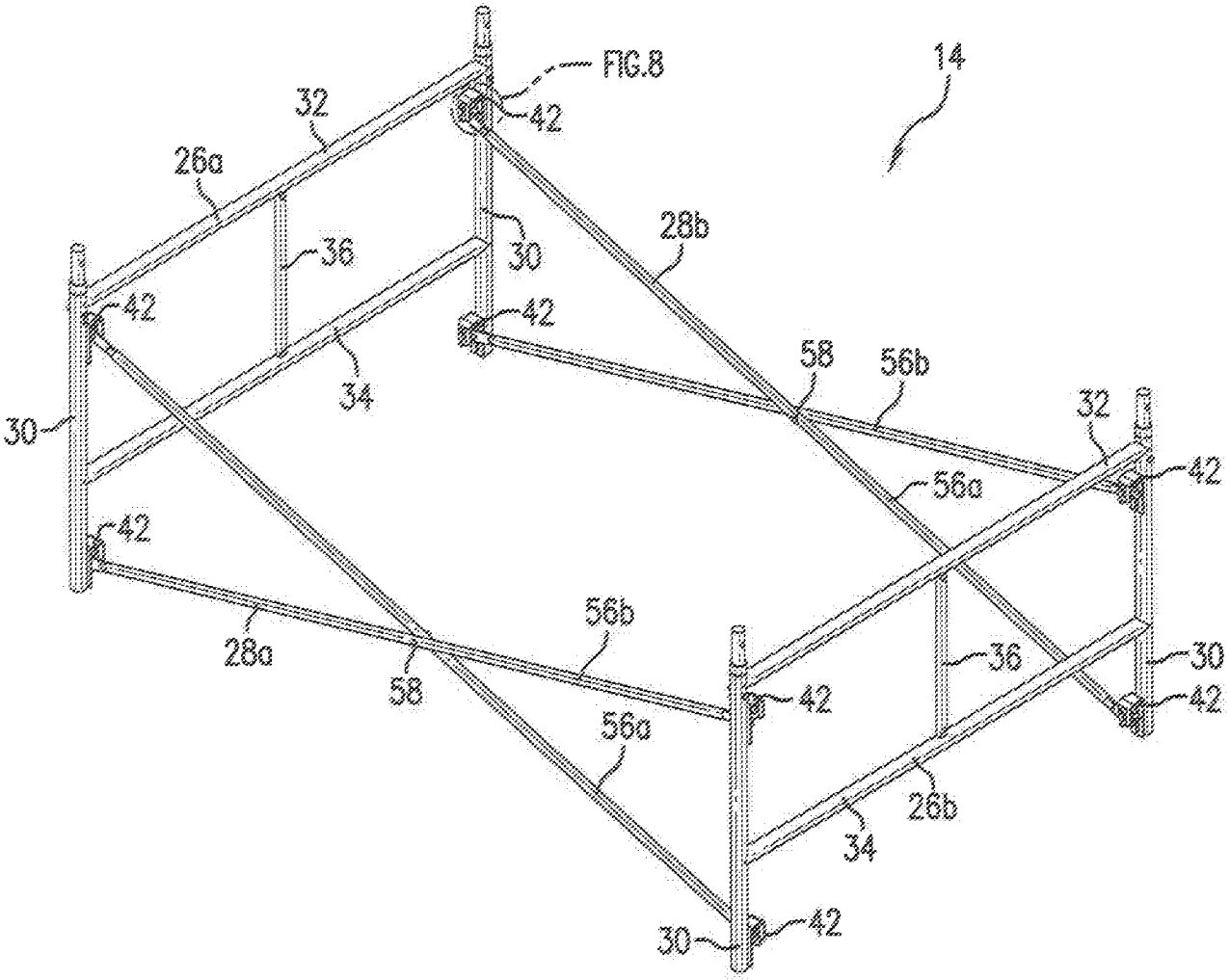
FIG. 6 is a perspective view of the portable stand of the present invention, shown separate from the dumpster bag.
Figure 7:
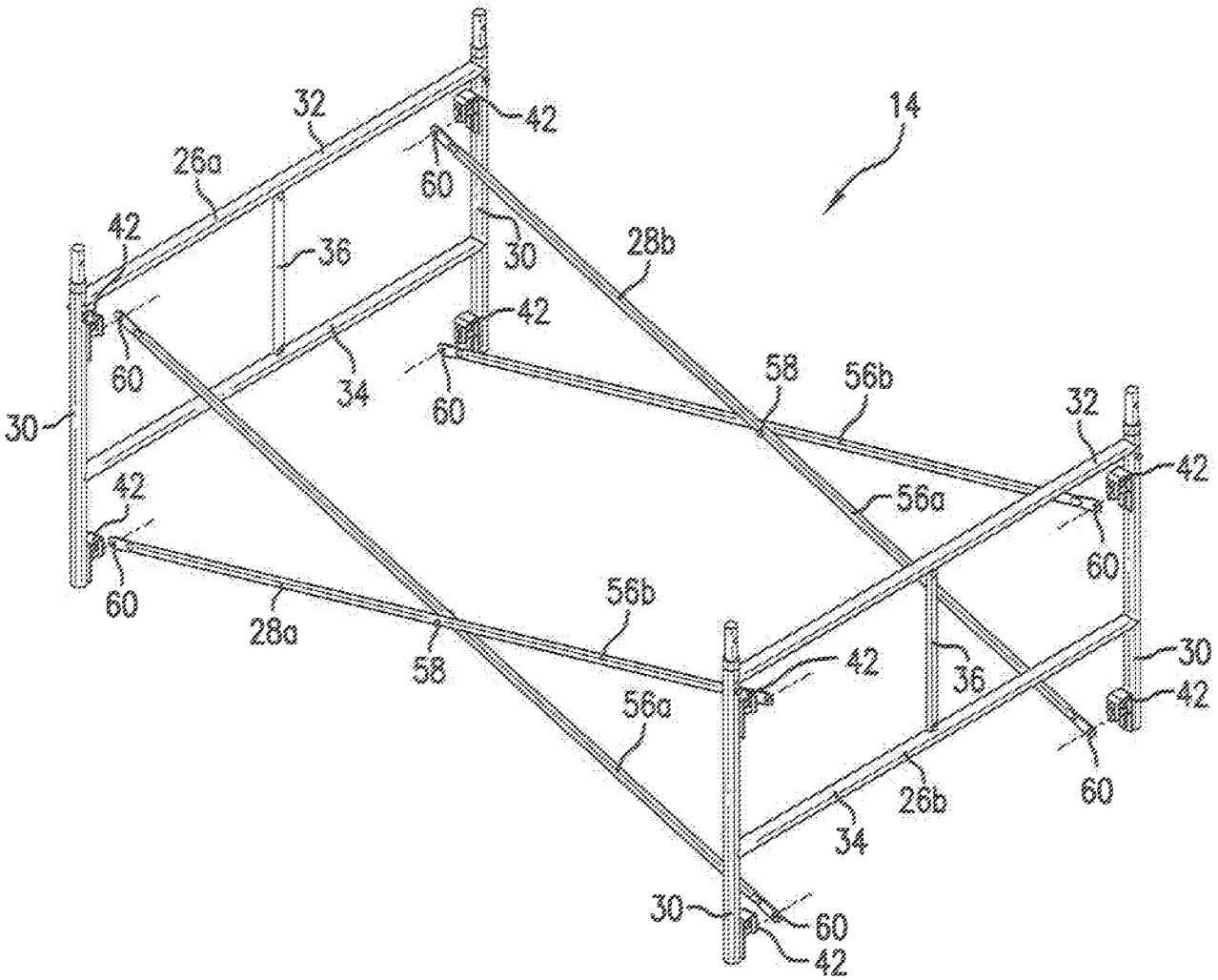
FIG. 7 is an exploded view of the portable stand of FIG. 6.

As best seen in FIGS. 6 and 7, the portable stand 14 comprises a first support frame 26*a*, a second support frame 26*b*, a first cross-member 28*a*, and a second cross-member 28*b*. The portable stand 14 is a temporary structure that is used to support the dumpster bag 12 once the dumpster bag 12 has been placed inside and attached to the portable stand 14.

When the portable stand 14 is in its assembled configuration, the first support frame 26*a* is opposite the second support frame 26*b*, and the first cross-member 28*a* is opposite the second cross-member 28*b*. That is, the first support frame 26*a* is attached to one end of the first cross-member 28*a*, and one end of the second cross-member 28*b* and the second support frame 26*b* is attached to the opposite end of the first cross-member 28*a* and the opposite end of the second cross-member 28*b*. Likewise, the first support frame 26*a* is substantially perpendicular to the first cross-member 28*a* and the second cross-member 28*b* and the second support frame 26*b* is also substantially perpendicular to the first cross-member 28*a* and the second cross-member 28*b*. As such, when it is in its assembled configuration, the first support frame 26*a*, second support frame 26*b*, first cross-member 28*a*, and second cross-member 28*b* of the portable stand 14 define a rectangle or square when viewed from above.

In the preferred embodiment of the portable stand 14, the first support frame 26*a* and the second support frame 26*b* have identical construction. Likewise, in the preferred embodiment of the portable stand 14, the first cross-member 28*a* and the second cross-member 28*b* have identical construction. This allows the components of the portable stand 14 to be interchangeable, thereby making it easier to store, transport and, if necessary, replace parts of the portable stand 14 without necessitating the replacement of the entire portable stand 14. Therefore, the first support frame 26*a* and the second support frame 26*b* will collectively be referred to as a support frame 26*a*, 26*b* of the portable stand 14, and the first cross-member 28*a* and the second cross-member 28*b* will collectively be referred to as a cross-member 28*a*, 28*b* of the portable stand 14. As such, the configuration disclosed herein for the support frame 26*a*, 26*b* applies equally to both the first and second support frames 26*a*, 26*b*, and the configuration disclosed herein for the cross-member 28*a*, 28*b* applies equally to both the first and second cross-members 28*a*, 28*b*.

While it is most preferable that the first and second support frames 26*a*, 26*b* have the same configuration and that the first and second cross-members 28*a*, 28*b* have the same configuration, one skilled in the art will recognize the different configurations that may be used without departing from the scope of the present invention. That is, when interchangeability is unwanted or unnecessary, the first support frame 26*a* may have a configuration that is different that the second support frame 26*b*, and the first cross-member 28*a* may have a configuration that is different than the second cross-member 28*b*, while the portable stand 14 may still fall within the scope of the present invention.

In one embodiment of the portable stand 14, the support frame 26*a*, 26*b* includes two vertical supports 30, an upper horizontal member 32, and a lower horizontal member 34. As may be seen in FIG. 6, the upper horizontal member 32 and lower horizontal member 34 are located between the two vertical supports 30, with the upper horizontal member 32 located below the upper end of the vertical supports 30 and the lower horizontal member 34 located above the lower end of the vertical supports 30. The upper horizontal member 32 and the lower horizontal member 34 are preferably attached substantially perpendicularly to the vertical supports 30. The purpose of the upper horizontal member 32 and the lower horizontal member 34 are to provide rigidity to the support frame 26*a*, 26*b* and to hold the vertical supports 30 in a substantially vertical position.

Optionally, the support frame 26*a*, 26*b* may include a strengthening bar 36 running between the upper horizontal member 32 and the lower horizontal member 34 in approximately the mid-point of the upper horizontal member 32 and the lower horizontal member 34. The strengthening bar 36, when utilized, is preferably parallel to the vertical supports 30 and perpendicular to the upper horizontal member 32 and the lower horizontal member 34. The purpose of the strengthening bar 36, when used, is to prevent any flexing of the upper horizontal member 32 and the lower horizontal member 34 when heavy loads are placed in the dumpster bag 12 held by the portable stand 14.

While the use of the upper horizontal member 32 and the lower horizontal member 34 (and optionally the strengthening bar 36) are discussed herein, it will be recognized by those skilled in the art that the support frame 26*a*, 26*b* may instead include alternative designs for the members located between the vertical supports 30. For example, the members may be mounted in such a way as to create an X-shaped set of members or one or more triangle or diagonal members in place of the upper horizontal member 32, the lower horizontal member 34, and the optional strengthening bar 36 without departing from the scope of the present invention.

The support frame 26*a*, 26*b* also includes a total of four attachment posts 38 for the cross-members 28*a*, 28*b* and a total of four lock posts 40, with each vertical support 30 including upper and lower attachment posts 38 and upper and lower lock posts 40 that project inward from the vertical support 30 and which are parallel to the upper horizontal member 32 and the lower horizontal member 34. Preferably, the lock posts 40 are located above the attachment posts 38.

The support frame 26*a*, 26*b* also includes a total of four cross-member locks 42 that are mounted on the four lock posts 40, with each vertical support 30 having upper and lower cross-member locks 42. The purpose of the cross-member locks 42 is to prevent the cross-members 28*a*, 28*b* from detaching from the support frame 26*a*, 26*b* once the portable stand 14 has been assembled. The cross-member locks 42 prevent the cross-members 28*a*, 28*b* from detaching from the support frame 26*a*, 26*b* by creating a blockage near the end of the attachment posts 38, which prevents the end of the cross-member 28*a*, 28*b* from moving past the cross-member lock 42.

Figure 8:
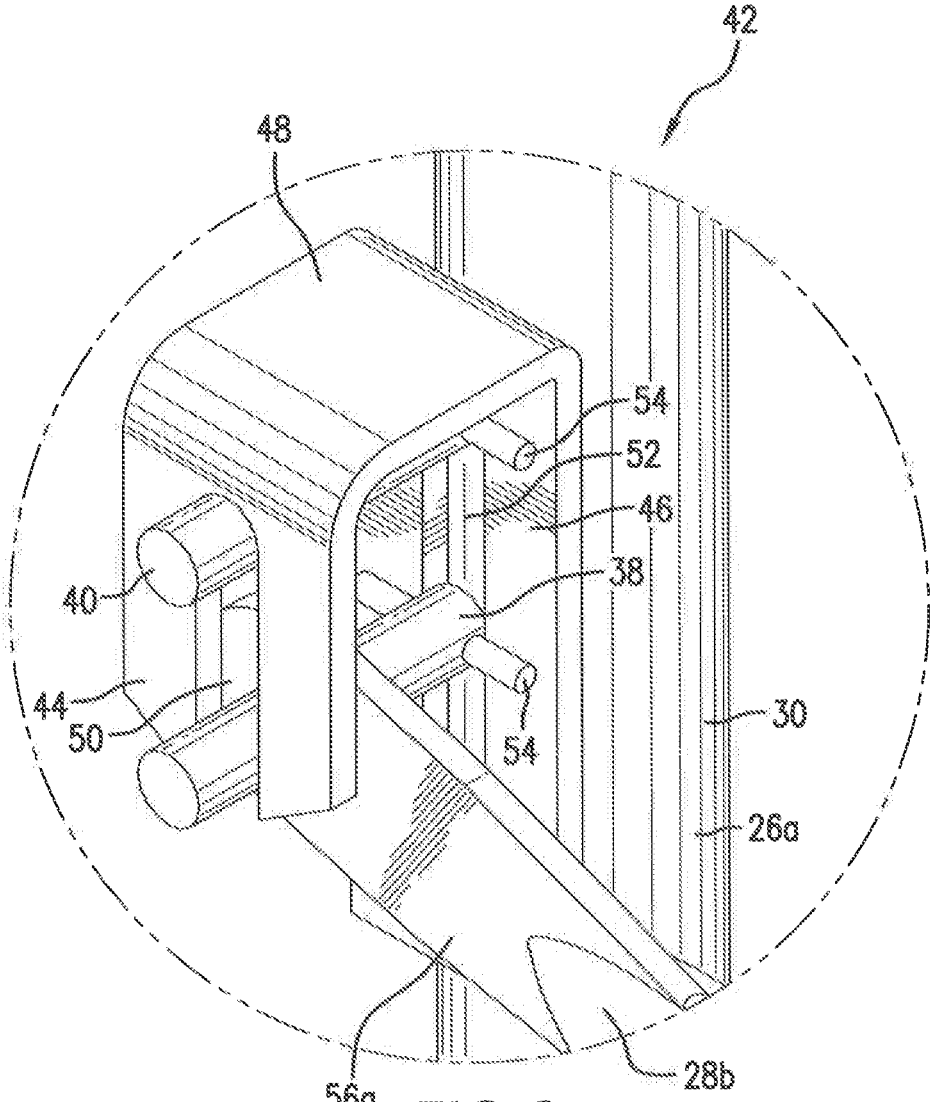
FIG. 8 is a close-up perspective view of the cross-member lock of the portable stand of FIG. 6.

In one embodiment of the present invention, the cross-member lock 42 takes the form of an upside-down U-shape as best seen in FIG. 8. The cross-member lock 42 includes a short arm 44 and a long arm 46 connected by a base 48. The short arm 44 of the cross-member lock 42 includes a slot 50 that is open on one end, wherein the width of the slot 50 is slightly larger than the diameter of the attachment posts 38. The length of the short arm 44 is slightly longer than the distance between the attachment post 38 and the lock post 40, such that when the base 48 of the cross-member lock 42 rests on the lock post 40, the end of the short arm 44 extends slightly beyond the lower edge of the attachment post 38. The long arm 46 of the cross-member lock 42 also includes a slot 52, but the slot 52 in the long arm 46 is not open on either end. The short arm 44 and the long arm 46 are parallel to each other, and the slot 50 of the short arm 44 and the slot 52 of the long arm 46 are aligned. The base 48 of the cross-member lock 42 connects the short arm 44 and the long arm 46 and has a length that is shorter than the length of the attachment posts 38.

To mount the cross-member lock 42 on the support frame 26*a*, 26*b*, during construction the cross-member lock 42 slides onto the attachment post 38 and the lock post 40 of the vertical support 26*a*, 26*b*, such that the attachment post 38 and the lock post 40 extend first through the slot 52 of the long arm 46 of the cross-member lock 42, and then through the slot 50 of the short arm 44 of the cross-member lock 42. Pins 54 are then attached to the attachment post 38 and the lock post 40 of the vertical support 30, such that the long arm 46 of the cross-member lock 42 is located between the vertical support 30 and pins 54. The pins 54 secure the cross-member lock 42 to the vertical support 30 such that the cross-member lock 42 cannot be removed or detached from the vertical support 30, but the cross-member lock 42 can still be slid vertically along the attachment posts 38 and locking posts 40 of the vertical support 30. By sliding the cross-member lock 42 vertically along the vertical support 30, it can be shifted from a locked configuration where the short arm 44 of the cross-member lock 42 blocks the end of the attachment post 38, such that the cross-member 26*a*, 26*b* cannot be removed or detached from the attachment post 38, to an unlocked configuration where the short arm 44 of the cross-member lock 42 does not block the end of the attachment post 38, thereby allowing the cross-member 26*a*, 26*b* to be freely attached to or detached from the attachment post 38 when the portable stand 14 is being set up or taken down.

In the preferred embodiment of the portable stand 14, the cross-member 26*a*, 26*b* includes a first diagonal member 56*a* and a second diagonal member 56*b* connected by a pivot 58 located substantially at the middle of the first diagonal member 56*a* and second diagonal member 56*b*. The first diagonal member 56*a* and second diagonal member 56*b* each also include an attachment aperture 60 at each end of the first diagonal member 56*a* and each end of the second diagonal member 56*b*.

The pivot 58 allows the first diagonal member 56*a* and the second diagonal member 56*b* to freely rotate relative to each other. The pivot 30 can be any type of pivot known in the art. For example, it may take the form of a pin, rivet, bolt, or other similar component that extends through the first diagonal member 56*a* and the second diagonal member 56*b* and has stops on each end.

The specific dimensions used for the support frame 26*a*, 26*b* and the cross-members 28*a*, 28*b* are selected according to the size of the dumpster bag 12 used. For example, in one embodiment of the portable stand 14 that would be used with a dumpster bag 12 having the example dimensions discussed above, the support frame 26*a*, 26*b* has a width of approximately 60 inches (152.4 cm) and a height of approximately 36 inches (91.44 cm), and the cross-member 28*a*, 28*b* has an overall width of approximately 104 inches (264.16 cm). However, it will be recognized by one skilled in the art that the dimensions of the support frame 26*a*, 26*b* and cross-members 28*a*, 28*b* can be varied to vary the overall size of the portable stand 14, such that the portable stand 14 may be used with smaller or larger dumpster bags.

While the support frame 26*a*, 26*b* and the cross-members 28*a*, 28*b* may be constructed of any material with sufficient strength to support the desired working load of the dumpster bag with stand 10 of the present invention, the support frame 26*a*, 26*b* and the cross-members 28*a*, 28*b* are preferably constructed of a metal. For example, either steel or aluminum can be used to constructed the support frame 26*a*, 26*b* and the cross-members 28*a*, 28*b*. Most preferably, the support frame 26*a*, 26*b* and the cross-members 28*a*, 28*b* are constructed of aluminum, which results in a lightweight, but high strength, portable frame 14.

To assemble the portable stand 14, the user lays out the first support frame 26*a*, the second support frame 26*b*, the first cross-member 28*a*, and the second cross-member 28*b*. The user then attaches the first cross-member 28*a* to the first support frame 26*a* by shifting the cross-member lock 42 located near the top of the vertical support 30 to its unlocked configuration and sliding the aperture 60 of the first diagonal member 56*a* over the attachment post 38, such that the attachment post 38 projects through the aperture 60. The user then shifts the cross-member lock 42 to its locked configuration. Then the user shifts the other cross-member lock 42 located near the bottom of the vertical support 30 to its unlocked configuration and slides the aperture 60 of the second diagonal member 56*b* over the attachment post 38 such that the attachment post 38 projects through the aperture 60. The user then shifts the cross-member lock 42 to its locked configuration.

Next, the user attaches the first cross-member 28*a* to the second support frame 26*b* by shifting the cross-member lock 42 located near the top of the vertical support 30 to its unlocked configuration and sliding the aperture 60 of the second diagonal member 56*b* over the attachment post 38, such that the attachment post 38 projects through the aperture 60. The user then shifts the cross-member lock 42 to its locked configuration. Then the user shifts the other cross-member lock 42 located near the bottom of the vertical support 30 to its unlocked configuration and slides the aperture 60 of the first diagonal member 56*a* over the attachment post 38, such that the attachment post 38 projects through the aperture 60. The user then shifts the cross-member lock 42 to its locked configuration.

The user then follows the same procedure to secure the second cross-member 28*b* to both the first support frame 26*a* and the second support frame 26*b*, after which the portable stand 14 is fully assembled.

In order to attach the dumpster bag 12 to the portable stand 14, the dumpster bag 12 is unloaded and unpacked, and then placed within the interior of the portable stand 14 with the bottom panel 20 of the dumpster bag 12 resting on the ground. The first and second side panels 16*a*, 16*b* and first and second end panels 18*a*, 18*b* are then unfolded upward until they are adjacent to the first and second support frames 26*a*, 26*b* (for the first and second end panels 18*a*, 18*b*, respectively) and the first and second cross-members 28*a*, 28*b* (for the first and second side panels 16*a*, 16*b*, respectively). Next, the lifting loop 24 on one corner of the dumpster bag 12 is looped over the adjacent vertical support 30 of the adjacent support frame 26*a*, 26*b*, as may be seen in FIGS. 1-4. If there is remaining slack in the lifting loop 24 after it has been looped over the vertical support 30, the lifting loop 24 is pulled outward, such that the lower side of the lifting loop 24 is tight against the vertical support 30, rotated one-half turn (180 degrees) to create an X-shaped crossing of the lifting loop 24, and then the lifting loop 24 is looped over the vertical support 30 again. The process is repeated until there is no remaining slack in the lifting loop 24, so that the lifting loop 24 is held tightly against the vertical support 30. This overall process is repeated for each lifting loop 24 of the dumpster bag 12 that is located adjacent to a vertical support 30 of the support frame 26*a*, 26*b*, such that all four corners of the dumpster bag 12 are removably secured to either the first support frame 26*a* or the second support frame 26*b*.

The use of the dumpster bag with stand 10 of the present invention provides a number of benefits over traditional metal dumpsters and existing dumpster bags. The portable stand 14 gives the dumpster bag 12 additional rigidity, which makes the dumpster bag 12 easier to fill. In addition, the additional rigidity provided by the portable stand 14 makes the dumpster bag much safer to load. That is, without the extra rigidity provided by the portable stand 14, debris in the dumpster bag can spill or fall out of the sides of prior art dumpster bags, potentially harming or injuring the individual loading the bag. The portable stand 14, and, more specifically, the looping of the lifting loops 24 around the vertical supports 30 of the support frames 26*a*, 26*b*, gives the dumpster bag a well-defined top edge or outer lip for safer loading of waste. That is, waste is less likely to catch on the edge of the dumpster bag 12 during loading and be thrown back toward the user. The well-defined top edge of the portable stand 14 also prevents the sides of the bag from folding under when loading the bag with large or heavy waste. The portable stand 14 gives the dumpster bag a solid support structure for greater ease of loading and safety. The portable stand 14 allows the dumpster bag 12 to be easily moved to a different location on the work site before it has been loaded due to the lightweight nature of the portable stand 14, while the portable stand 14 still has sufficient weight to prevent the dumpster bag 12 from blowing away or being affected by the wind before waste has been placed inside. Finally, the portable stand 14 allows for easy lifting and loading of the dumpster bag 12 into a hoist truck because the dumpster bag 12 is held stationary and upright during lifting, even after the lifting loops 24 have been disconnected from the vertical supports 30 of the support frame 26*a*, 26*b*.

It will be recognized by one skilled in the art that the size, configuration, or dimensions of the dumpster bag with stand 10 of the present invention may be adjusted to allow for dumpster bags of various sizes. Likewise, it will be recognized by one skilled in the art that the materials from which the dumpster bag with stand 10 of the present invention is made may be varied without departing from the scope of the present invention.

While the invention has been described in the specification and illustrated in the drawings with reference to certain preferred embodiments, it will be understood by those skilled in the art that various changes may be made and equivalents may be substituted for elements thereof without departing from the scope of the present invention as defined in the appended claims. In addition, many modifications may be made to adapt to a particular situation or material to the teachings of the invention, as defined in the appended claims, without departing from the essential scope thereof. Therefore, it is intended that the present invention not be limited to the particular embodiments illustrated by the drawings and described in the specification as the best modes presently contemplated for carrying out the present invention, but that the present invention will include any embodiments falling within the description of the appended claims.

What is claimed is:

1. A dumpster bag with stand comprising:

a flexible dumpster bag, wherein the flexible dumpster bag comprises:

a first end panel;

a second end panel, wherein the second end panel is located opposite the first end panel;

a first side panel;

a second side panel, wherein the second side panel is located opposite the first side panel;

a bottom panel; and a first lifting strap located adjacent to the first end panel, wherein the first lifting strap includes a lifting loop at each end of the first lifting strap;

a second lifting strap located adjacent to the second end panel, wherein the second lifting strap includes a lifting loop at each end of the second lifting strap;

a third lifting strap located between the first lifting strap and the second lifting strap, wherein the third lifting strap includes a lifting loop at each end of the third lifting strap;

a portable stand, wherein the portable stand comprises:

a first support frame;

a second support frame, wherein the second support frame is located opposite the first support frame;

a first cross-member, wherein the first cross-member is located between the first support frame and the second support frame, and is removably secured to the first support frame and the second support frame;

a second cross-member, wherein the second cross-member is located between the first support frame and the second support frame opposite the first support frame, and is removably secured to the first support frame and the second support frame;

wherein the dumpster bag is removably secured to the first support frame and the second support frame of the portable stand.

2. The dumpster bag with stand of claim 1, wherein:

the first end panel is attached to the first side panel, the second side panel, and the bottom panel;

the second end panel is attached to the first side panel, the second side panel, and the bottom panel;

the first side panel is attached to the first end panel, the second end panel, and the bottom panel;

the second side panel is attached to the first end panel, the second end panel, and the bottom panel; and the bottom panel is attached to the first end panel, the second end panel, the first side panel, and the second side panel;

to form an open top box-shaped bag.

3. The dumpster bag with stand of claim 2, wherein the first end panel, the second end panel, the first side panel, the second side panel, and the bottom panel are attached with continuous reinforced stitching.

4. The dumpster bag with stand of claim 1, wherein the dumpster bag comprises a fabric.

5. The dumpster bag with stand of claim 4, wherein the fabric is polypropylene fabric.

6. The dumpster bag with stand of claim 1, wherein at least three lifting straps extend down the first side panel, then extend across the bottom panel, and then extend up the second side panel.

7. The dumpster bag with stand of claim 6, wherein at least three lifting straps are secured to the first side panel, bottom panel, and second side panel with continuous reinforced stitching.

8. The dumpster bag with stand of claim 1, wherein:

the lifting loops of the first lifting strap are integral to the first lifting strap;

the lifting loops of the second lifting strap are integral to the second lifting strap; and the lifting loops of the third lifting strap are integral to the third lifting strap.

9. The dumpster bag with stand of claim 8, wherein:

the lifting loops of the first lifting strap comprise the ends of the first lifting strap looped back on the first lifting strap and attached with continuous reinforced stitching;

the lifting loops of the second lifting strap comprise the ends of the second lifting strap looped back on the second lifting strap and attached with continuous reinforced stitching; and the lifting loops of the third lifting strap comprise the ends of the third lifting strap looped back on the third lifting strap and attached with continuous reinforced stitching.

10. The dumpster bag with stand of claim 1, wherein the dumpster bag comprises at least one additional lifting strap located between the first lifting strap and the third lifting strap, or between the second lifting strap and the third lifting strap.

11. The dumpster bag with stand of claim 1, wherein the first support frame and the second support frame of the portable stand each comprise two vertical supports and at least two horizontal members extending between the vertical supports.

12. The dumpster bag with stand of claim 11, wherein the horizontal members are approximately perpendicular to the vertical supports.

13. The dumpster bag with stand of claim 12 wherein the first support frame and the second support frame further include a vertical strengthening bar extending between the at least two horizontal members.

14. The dumpster bag with stand of claim 13, wherein the vertical strengthening bar is approximately parallel to the vertical supports and approximately perpendicular to the horizontal members.

15. The dumpster bag with stand of claim 1, wherein the first cross-member and the second cross-member each comprise two diagonal members and a pivot.

16. The dumpster bag with stand of claim 15, wherein the pivot extends through the two diagonal members.

17. The dumpster bag with stand of claim 1, wherein the first support frame and the second support frame each include four attachment posts, and the first cross-member and the second cross-member each include four apertures.

18. The dumpster bag with stand of claim 17, wherein:

two of the attachment posts of the first support frame extend through two of the apertures of the first cross-member;

two of the attachment posts of the first support frame extend through two of the apertures of the second cross-member;

two of the attachment posts of the second support frame extend through two of the apertures of the first cross-member; and two of the attachment posts of the second support frame extend through two of the apertures of the second cross-member.

19. The dumpster bag with stand of claim 1, wherein the first support frame and the second support frame each include four locks for removably securing the first cross-member and the second cross-member to the first support frame and the second support frame.

20. The dumpster bag with stand of claim 1, wherein the lifting loops of the first lifting strap are removably secured to the first support frame and the lifting loops of the second lifting strap are removably secured to the second support frame.

* * * * *